US007218874B2

(12) United States Patent
Tomiyori et al.

(10) Patent No.: US 7,218,874 B2
(45) Date of Patent: May 15, 2007

(54) IMAGE FORMING APPARATUS AND METHOD FOR CONTROLLING FIXING MECHANISM PORTION

(75) Inventors: Minoru Tomiyori, Kyoto (JP); Akira Kohno, Nara (JP); Hideshi Izumi, Nara (JP); Susumu Murakami, Kyoto (JP); Yoshie Iwakura, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 97 days.

(21) Appl. No.: 11/029,598

(22) Filed: Jan. 6, 2005

(65) Prior Publication Data

US 2005/0158066 A1 Jul. 21, 2005

(30) Foreign Application Priority Data

Jan. 9, 2004 (JP) ..... 2004-004346

(51) Int. Cl.
*G03G 15/20* (2006.01)

(52) U.S. Cl. ..... 399/68

(58) Field of Classification Search ..... 219/216; 399/43, 45, 67, 68, 69, 70, 328, 389, 396
See application file for complete search history.

(56) References Cited

U.S. PATENT DOCUMENTS 5,289,247 A * 2/1994 Takano et al. ..... 399/68

FOREIGN PATENT DOCUMENTS

| | | | |
|---|---|---|---|
| JP | 7-13461 | A | 1/1995 |
| JP | 7-261584 | A | 10/1995 |
| JP | 10-207154 | A | 8/1998 |
| JP | 2002-49266 | A | 2/2002 |
| JP | 2003-57988 | A | 2/2003 |
| JP | 2003-076212 | | 3/2003 |
| JP | 2003-177627 | A | 6/2003 |
| JP | 2004-109169 | A | 4/2004 |

* cited by examiner

*Primary Examiner*—Hoang Ngo
(74) *Attorney, Agent, or Firm*—Birch, Stewart, Kolasch & Birch, LLP

(57) ABSTRACT

A rotation speed of a heating roller 39*a* and a pressure roller 39*b* is variably controlled by a CPU 542 based on a sheet size to be printed, a direction the sheet is to be passed, and a number of sheets to be printed. Specifically, variable control of the rotation speeds of the heating roller 39*a* and the pressure roller 39*b* by the CPU 542 is based on an occurrence of a pass-through area 39*b*1 and a non-pass-though area 39*b*2 by a sheet of recording paper with respect to a roller lengthwise direction (axial direction) of a position at which the sheet of recording paper passes between the heating roller 39*a* and the pressure roller 39*b*, and controlled based on a thermal expansion coefficient of a roller diameter of the non-pass-though area 39*b*2 of the pressure roller 39*b*.

12 Claims, 13 Drawing Sheets

FIG. 6A PriorArt

| (paper transport speed : rotation speed of fixing roller) ratio | number of successively printed sheets | check item | | |
|---|---|---|---|---|
| | | change in print magnification (magnification change in leading/trailing edge) | rub-off of printing surface | smearing of trailing edge of sheet |
| 1 : 0.90 | from 1st to 10th sheet | ▲ | ×× | ××× |
| | from 11th to 30th sheet | △ | ▲ | ×× |
| | 40th sheet and above | ○ | △ | × |
| 1 : 0.95 | from 1st to 10th sheet | △ | ×× | ×× |
| | from 11th to 30th sheet | △ | ▲ | × |
| | 40th sheet and above | ○ | ○ | ▲ |
| 1 : 1.00 | from 1st to 10th sheet | △ | △ | △ |
| | from 11th to 30th sheet | ○ | △ | △ |
| | 40th sheet and above | ◎ | ○ | ○ |
| 1 : 1.02 | from 1st to 10th sheet | ○ | ◎ | ○ |
| | from 11th to 30th sheet | ◎ | ◎ | ◎ |
| | 40th sheet and above | △ | ◎ | ◎ |
| 1 : 1.03 | from 1st to 10th sheet | ◎ | ◎ | ○ |
| | from 11th to 30th sheet | ○ | ◎ | ○ |
| | 40th sheet and above | × | ◎ | ◎ |
| 1 : 1.05 | from 1st to 10th sheet | ○ | ◎ | ○ |
| | from 11th to 30th sheet | △ | ◎ | ◎ |
| | 40th sheet and above | ×× | ◎ | ◎ |

Explanation of symbols

◎ excellent

○ fine

△ somewhat inferior
(Occurrence of deficiency was within the allowable range but not infrequent enough to be rated ○)

▲ somewhat inferior
(Occurrence of deficiency was very infrequent but slightly out of the allowable range.)

× inferior

×× inferior

××× inferior
(The more the number of × is, the more frequently deficiency occurred.)

FIG. 6B

| (paper transport speed : rotation speed of fixing roller) ratio | number of successively printed sheets | check item | | |
|---|---|---|---|---|
| | | change in print magnification (magnification change in leading/trailing edge) | rub-off of printing surface | smearing of trailing edge of sheet |
| (1 : 1.02) ⇒ (1 : 0.90) | from 1st to 10th sheet | ○ | ◎ | ○ |
| | from 11th to 30th sheet | ◎ | ○ | △ |
| | 40th sheet and above | ○ | △ | × |
| (1 : 1.02) ⇒ (1 : 0.95) | from 1st to 10th sheet | ○ | ◎ | ○ |
| | from 11th to 30th sheet | ◎ | ◎ | ◎ |
| | 40th sheet and above | ○ | ○ | ○ |
| (1 : 1.02) ⇒ (1 : 1.00) | from 1st to 10th sheet | ◎ | ◎ | ○ |
| | from 11th to 30th sheet | ◎ | ◎ | ◎ |
| | 40th sheet and above | ◎ | ◎ | ○ |

Explanation of symbols

◎ excellent

○ fine

△ somewhat inferior
(Occurrence of deficiency was within the allowable range but not infrequent enough to be rated ○)

× inferior

IMAGE FORMING APPARATUS AND METHOD FOR CONTROLLING FIXING MECHANISM PORTION

BACKGROUND OF THE INVENTION

This application claims priority under 35 U.S.C. § 119(a) on Patent Application No. 2004-004346 filed in Japan on Jan. 9, 2004, the entire contents of which are hereby incorporated by reference.

The present invention relates to image forming apparatuses such as scanner devices, copying devices, facsimile devices, and compound machines that incorporate any of these devices, and methods for controlling fixing mechanism portions.

Conventionally, with image forming apparatuses such as scanner devices, copying devices, facsimile devices, and compound machines that incorporate any of these devices, a sheet of recording paper on which a toner image has been transferred is passed through a fixing mechanism portion and the toner image is thermally fixed onto the sheet of recording paper by the fixing mechanism portion. The fixing mechanism portion is provided with a pair of roller members arranged in opposition to each other and at least one of these members is constituted as a heating roller that acts as a heat source for fixing. That is, the toner image is thermally fixed onto the sheet of recording paper by transporting the sheet of recording paper while it is supported sandwiched between the pair of roller members.

In this regard, with this kind of fixing mechanism portion, it has been proposed that the warming up time of the device can be shortened and its energy efficiency improved without increasing the electrical power consumption (power supply) of the device by making the roller body thinner to reduce its thermal capacity.

However, when using a roller body that has been made thinner in this way, the roller body's thermal transferability in the axial direction is reduced due to being made thinner. For this reason, it becomes difficult to keep the entire roller body at a uniform temperature. For example, when a sheet of recording paper of a size smaller than the roller body's heating range has passed through, in contrast to the passed-through portion of the sheet of recording paper where heat has been absorbed by the sheet of recording paper, since heat is not absorbed at the portion where the sheet of recording paper does not pass through, an excessive rise in the roller temperature (hereafter, "irregular temperature rise at portions un-passed by paper") occurs at this portion. When a sheet of recording paper larger than the above-mentioned size is passed through under conditions in which such an irregular temperature rise at portions un-passed by paper has occurred, risks are posed such as excessive fixing at the portion of the excessive temperature rise, changes to the glossiness of the toner on the sheet of recording paper, and excessively fixed portions causing high-temperature offset such that toner adheres to the heating roller.

In order to avoid this irregular temperature rise at portions un-passed by paper, conventional fixing mechanism portions have a plurality of heaters of different heating ranges arranged inside the roller body, and heaters to which electricity is to be supplied are selected according to the size of the sheet of recording paper to be passed through (for example, see JP 2003-177627A).

FIGS. 8 and 9 show the internal structure of a conventional fixing mechanism portion 39 and an overall configuration of a heating roller and a configuration of a control circuit therein.

As shown in these drawings, a heating roller 39*a* is provided with a roller body 391 as a fixing member, halogen heaters 392 as heating means for heating the roller body 391, temperature sensors 393A and 393B constituted by a temperature detection means for detecting a surface temperature of the roller body 391, a control circuit 540, and a pressure roller 39*b* arranged in opposition so as to be opposing the heating roller 39*a*.

The halogen heaters 392 are arranged inside the roller body 391 and are provided with a main heater 392*a* positioned as a heater aligned with a center reference of a sheet of recording paper in a central portion of the roller axial direction and sub-heaters 392*b* arranged on both sides on the main heater 392*a* in the axial direction. The main heater 392*a* is positioned below the roller axis. On the other hand, the sub-heaters 392*b* are positioned above the roller axis. The main heater 392*a* and the sub-heaters 392*b* are constituted by a filament F accommodated inside a glass tube G, and the filaments F are formed such that portions corresponding to areas to be heated by the heaters 392*a* and 392*b* serve as heat-generating locations. Infrared rays are irradiated to achieve a predetermined thermal distribution by applying electricity to the filaments F from the control circuit 540 and the inner surface of the heating roller 391 becomes heated. Furthermore, the main heater 392*a* and the sub-heaters 392*b* are respectively and independently temperature-controlled by the control circuit 540.

The roller body 391 is heated by the halogen heaters 392 (the main heater 392*a* and the sub-heater portion 392*b*) to a predetermined temperature (for example, 200° C.) and thus heats a sheet of recording paper P, which is a recording medium, that passes through a nip area K (nip area K between the heating roller 39*a* and the pressure roller 39*b*) of the fixing mechanism portion 39. Furthermore, the heating roller 39*a* is provided with a core 39*a*1, which is the body thereof, and a mold release layer 39*a*2 formed on an outer surface of the core 39*a*1 to prevent the toner on the sheet of recording paper from offsetting.

A ferrous material such as iron or stainless steel for example, or an alloy of these, is used for the core 39*a*1. It is also possible to use a metal such as aluminum or copper. For the mold release layer 39*a*2, a fluorocarbon resin such PFA (a copolymer of tetrafluoroethylene and perfluoroalkyl vinyl ether) and PTFE (polytetrafluoroethylene), silicone rubber, or fluorocarbon rubber is used.

The pressure roller 39*b* is structured such that it has a heat-resistant elastic material layer 39*b*2 such as silicone rubber around the outer surface of the core 39*b*1 of iron, stainless steel, or aluminum, or the like. A mold release layer may be formed with the same fluorocarbon resin as in the case of the heating roller 39*a* on the surface of the heat-resistant elastic material layer 39*b*2 of the pressure roller 39*b*. It should be noted that the pressure roller 39*b* is configured such that it is pressed against the heating roller 39*a* with a force of approximately 200 N by an elastic member such as a spring not shown in the drawings, and in this way the nip area K is formed with a predetermined width between the pressure roller 39*b* and the heating roller 39*a*.

On the other hand, the control circuit 540 is configured so as to control the heating roller 39*a* at a fixing temperature (200° C.) with a direct heating method using the halogen heaters 392. That is, the control circuit 540 is provided with drivers 541 that supply electricity to the heaters 392*a* and 392*b*, a driver 544 that rotationally drives the roller body 391, a CPU 542 that controls the drivers, and input circuits 543 that receive detection signals from temperature sensors 533A and 533B, and is configured to maintain the surface temperature of the heating roller 39*a* at the fixing temperature by alternating the state of power supply to the heaters 392*a* and 392*b* based on the detection signals from the temperature sensors 533A and 533B. Specifically, the state of the power supply to the main heater 392*a* is alternately based on a temperature detection signal from the main temperature sensor 533A positioned in the range heated by the main heater 392*a*. On the other hand, the state of the power supply to the sub-heaters 392*b* is alternately based on a temperature detection signal from the sub temperature sensor 533B positioned in the range heated by the sub-heaters 392*b*.

Then, while electricity is supplied to only the main heater 392*a* when a small-size sheet is passing through, electricity is supplied to both the main heater 392*a* and the sub-heaters 392*b* when a large-size sheet is passing through. In this way, it is possible to heat only the area on the roller body 391 on which the sheet of recording paper passes through.

In this regard, with such power supply control for the main heater 392*a* and the sub-heaters 392*b*, although it is possible that only the main heater 392*a* is supplied electricity (ON) while the sub-heaters 392*b* are not supplied electricity (OFF) when a small-size sheet is passing through, if the sub-heaters 392*b* are completely turned OFF, the temperature drops extremely at the axial-direction end portions of the heating roller 39*a*, and then, even when electricity supply (ON) to the sub-heaters 392*b* is started in order for a large-size sheet to be subsequently passed through, there is a problem in that the temperature at the axial-direction end portions of the heating roller 39*a* does not rise rapidly and a fixing deficiency occurs due to an insufficient amount of heat. For this reason, with conventional image forming apparatuses, the sub-heaters 329*b* are not turned OFF completely even when a small-size sheet is being passed through, and a standby heating is performed such that the temperature at the axial-direction end portions of the heating roller 39*a* is maintained to a certain extent by intermittently alternating the ON and OFF control. Specifically, if full electricity supply is given as 100%, then electricity supply of 30% is carried out with ON-OFF control. In this way, the above-mentioned fixing deficiency problem is solved when transitioning to printing of a large-size sheet.

On the other hand, control is performed by carrying out ON-OFF control of the sub-heaters 329*b* when printing a small-size sheet such that the central portion of the heating roller 39*a* to which the small-size sheet is to be passed through becomes a set fixing temperature in consideration of such factors as heat conduction to the sheet of recording paper, and the temperature at the axial-direction end portions of the heating roller 39*a* is raised to the temperature of standby heating when continuing to successively print small-size sheets since the sheets of recording paper do not pass through.

FIG. 10 shows an example of temperature distribution in the axial direction of the heating roller 39*a*. The curved line shown as a solid line in this drawing represents the temperature distribution when a small-size sheet has passed through and the curved line shown as a broken line represents the temperature distribution when a large-size sheet has passed through.

As shown in FIG. 10, when large-size sheets are passing through, the entire axial-direction length of the heating roller 39*a* is controlled at approximately the set fixing temperature no matter how many sheets are printed, but when small-size sheets are passing through, although control of the set fixing temperature is achieved at the beginning of printing, the temperature at the axial-direction end portions of the heating roller 39*a* continues to be raised by the preheating amount and, in accordance with the increasing number of printed sheets, the temperature becomes higher than the set fixing temperature (shown by the numerical symbol 81 in this drawing). As a result of measurements with an actual device, it was found that a temperature gap T at this time was in the range of 30° C. to 40° C.

Further still, a discrepancy in the thermal expansion of the pressure roller 39*b* itself, which is arranged in opposition to and pressed against the heating roller 39*a*, was caused due to the occurrence of the temperature gap T, and the diameter itself of the pressure roller 39*b* was different in the axial direction at a central area (paper pass-through area) and end areas (paper non-pass-through areas) due to this discrepancy in thermal expansion. As shown in FIG. 11, the difference in roller diameter is such that L1 (paper non-pass-through areas)>L2 (paper pass-through area) and the diameter of the paper non-pass-through areas becomes larger than the diameter of the paper pass-through area. In FIG. 11, the L2 portion is the portion at which small-size sheets pass through.

Incidentally, in recent years, an increasing number of image forming apparatuses employ a buildup system in order to achieve device compactness and a reduction in the area occupied by the device. That is, there are many formations in which there is a paper-supply portion for storing and transporting sheets of recording paper at the lowest part of the device, an image-forming portion directly above the paper-supply portion, and a document reading portion at the highest portion part of the device.

In such devices, a sheet of recording paper is transported substantially vertically, and at this time the transport force of the sheet of recording paper is subject to the influence of gravity. For example, when the sheet of recording paper passes through the transfer mechanism portion and is transported to the fixing mechanism portion, the sheet of recording paper naturally has an inclination to fall in the direction of the transfer mechanism portion due to the influence of gravity. For this reason, ordinarily it is usual for the peripheral roller speed of the fixing mechanism portion (paper transport speed) to be slightly faster than the speed at which the sheet of recording paper passes through the transfer mechanism portion (peripheral roller speed of transfer mechanism portion), and the speed ratio thereof becomes [(speed at which sheet of recording paper passes through transfer mechanism portion):(speed at which sheet of recording paper passes through fixing mechanism portion) =1.0:(1.02 to 1.005)].

With devices that transport the sheets of recording paper substantially vertically in this way, when the paper width closely resembles the approximate total length of the fixing rollers (the heating roller 39*a* and the pressure roller 39*b*) of the fixing mechanism portion by which the sheets of recording paper are carried, there is no discrepancy in thermal expansion such as that described above at the pressure roller 39*b*, and therefore the fixing and transfer processes can be carried out normally with the above-mentioned speed ratio.

However, when the width of the paper to be transported is that of paper that is narrow (such as for lengthwise transport of a small-size sheet) with respect to the fixing rollers (the heating roller 39*a* and the pressure roller 39*b*), temperature unevenness occurs as described above at the central area (paper pass-through area) of the fixing rollers (the heating roller 39*a* and the pressure roller 39*b*) at which the sheets of recording paper pass through and the side areas (paper non-pass-through areas) at which the sheets of recording paper do not pass through, and a discrepancy occurs in the thermal expansion of the pressure roller 39*b* due to this temperature unevenness such that the pressure roller diameters of the paper pass-through area and the paper non-pass-through areas become different as shown in FIG. 11. Since the paper transport speed of the fixing rollers is determined by the peripheral roller speed of the large-diameter non-pass-through areas of the pressure roller 39*b*, the relative speed ratio changes with respect to the paper transport speed in the transfer process. Specifically, the paper transport speed in the fixing process becomes gradually faster with respect to the paper transport speed in the transfer process in accordance with the thermal expansion of the paper non-pass-through areas of the pressure roller 39*b*. This disparity becomes conspicuous during successive printing.

The present inventors conducted tests regarding the extent of change in paper transport speeds during the fixing process in successive printing. In these tests, the dimensional error (magnification change) of documents and printing was measured in respective locations at a leading edge area, a central area, and a trailing edge area of sheets of recording paper when 50 sheets were successively printed in the respective cases of when A4-size sheets of recording paper were inserted sideways with respect to the paper transport direction (so called "sideways transport") and when the sheets were inserted lengthwise (so called "lengthwise transport"). The results thereof are shown in FIG. 12. FIG. 12A is the test results for when A4-size sheets of recording paper were transported sideways and FIG. 12B is the test results for when A4-size sheets of recording paper where transported lengthwise.

The case of sideways transport of A4-size sheets of recording paper corresponds to the passage of paper for large-size sheets and, as shown by the broken line in FIG. 10, the entire axial-direction length of the heating roller 39*a* is controlled at approximately the set fixing temperature no matter how many sheets were printed. Accordingly, there is no temperature unevenness of the heating roller 39*a* and no discrepancy in thermal expansion occurs in the pressure roller 39*b* that is arranged in opposition to it. For this reason, as shown in FIG. 12A, dimensional error (magnification change) of the document and the printing is not related to the number of printed sheets and the difference between the leading edge area and the trailing edge area of the sheets of recording paper is kept approximately constant.

In contrast to this, the case of lengthwise transport of A4-size sheets of recording paper corresponds to the passage of paper for so-called small-size sheets and, as shown by the solid line in FIG. 10, temperature unevenness occurs at the paper pass-through area and the paper non-pass-through areas such that, as shown in FIG. 11, the diameter of the pressure roller 39*b* is different at the paper pass-through area and the paper non-pass-through areas. The difference in the diameter of the pressure roller 39*b* increases according to the increase in the number of sheets printed. As a result of this, as shown in 12B, although the dimensional error at the leading edge area of the sheets of recording paper is not related to the number of sheets printed and is maintained at approximately 98.8%, this changes by approximately 0.5% from 99.3% to 98.8% at the trailing edge area of the sheets of recording paper according to the increase in the number of sheets printed. And it was found that this variation in dimensional error was a cause of transfer misalignment at the trailing edge area of the sheets of recording paper.

That is to say, when a sheet of recording paper being transported has a length that substantially spans the transfer roller and the fixing roller, the printing at the leading edge area of the sheet of recording paper is controlled according to the speed of the transfer roller and the printing of the trailing edge area is controlled according to the speed of the fixing roller, but in the case of successive printing, since the transport speed of the fixing roller gradually becomes faster in comparison to the transport speed of the transfer roller with each increase in the number of sheets printed, the trailing edge area (transfer side) of the sheets of recording paper becomes strongly pulled on by the fixing roller and transfer misalignment occurs at the trailing edge area side of the sheets of recording paper.

SUMMARY OF THE INVENTION

The present invention has been devised to solve these problems, and it is an object thereof to provide an image forming apparatus and a method for controlling a fixing mechanism portion in which a rotational speed of the fixing rollers is variably controlled and the rotational speed of the fixing rollers is controlled so as to automatically change due to detection of a size of a paper sheet of a print request and a transport direction therein and a number of sheets to be printed, such that there is no occurrence of transfer misalignment even when carrying out successive printing of small-size sheets.

An image forming apparatus according to the present invention is provided with a paper transport means for transporting a sheet of paper, an image forming means for forming an image on the sheet of paper transported by the paper transport means, and a discharge means for discharging the sheet of paper on which an image has been formed by the image forming means, wherein the image forming means has a transfer mechanism portion that transfers the image to the sheet of paper and a fixing mechanism portion that fixes the transferred image, and is provided with a control means for variably controlling a rotation speed of a heating roller and a pressure roller that constitute the fixing mechanism portion based on a size of the sheet of paper to be printed, a paper pass-through direction, and a number of sheets to be printed.

In this case, the variable control of a rotation speed of the heating roller and the pressure roller by the control means is based on an occurrence of a pass-through area and a non-pass-though area of a sheet of paper with respect to a roller lengthwise direction (axial direction) of a position at which the sheet of paper passes between the heating roller and the pressure roller, and control is based on a thermal expansion coefficient of a roller diameter of the non-pass-though area. Specifically, a table showing correspondence between a surface temperature and a thermal expansion of the pressure roller is stored in advance in the control means, and the control means respectively detects the surface temperatures of the pressure roller at the pass-through area and the non-pass-though area, and calculates a thermal expansion coefficient of a roller diameter of the non-pass-though area by referencing the table based on the detected temperatures. Then, in consideration of roller diameter variation of the paper non-pass-through area due to differences in the calculated thermal expansion coefficients, the rotation speeds of the heating roller and the pressure roller are controlled so as to be constant.

Furthermore, depending on an input of a printing request and printing conditions to the apparatus, variable control of a rotation speed of the heating roller and the pressure roller by the control means is performed continually from a commencement until a completion of printing based on the table. In this case, based on a transport speed of a sheet of paper that passes through the transfer mechanism portion, a variable control width of a rotation speed of the heating roller and the pressure roller is in a range expressed by a relative equation of the following formula: [(transport speed of sheet that passes through the transfer mechanism portion):(variable width of rotation speeds of the heating roller and the pressure roller)=1.0:(0.95 to 1.02)].

With such a configuration, even in the case of successive printing, the transport speed of the sheet of recording paper due to the transfer mechanism portion and the transport speed of the sheet of recording paper due to the fixing mechanism portion can always be kept at the same speed ratio from the commencement until the completion of printing. Accordingly, it is possible form excellent images without transfer misalignment at the trailing edge area of the sheets of recording paper even when performing successive printing with small-size sheets.

Further still, a drive member for sheet transport arranged at an upstream side in a paper transport direction of the fixing mechanism portion is controlled at an equivalent speed to a paper transport speed of the fixing mechanism portion in accordance with a variability of a paper transport speed of the fixing mechanism portion. In this way, the speed of the paper transport system downstream from the fixing mechanism portion (for example, the discharge mechanism portion) is also controlled at the same speed as the speed of the fixing mechanism portion, and therefore, without bending the sheets of recording paper while they are being transported from the fixing mechanism portion to the discharge mechanism portion, there is no worry of the sheets being rubbed by peripheral members or pulled upon.

Furthermore, a method for controlling a fixing mechanism portion according to the present invention in regards to an image forming apparatus provided with a paper transport means for transporting a sheet of paper, an image forming means having a transfer mechanism portion that transfers an image to the sheet of paper transported by the paper transport means and a fixing mechanism portion that fixes the transferred image, and a discharge means for discharging the sheet of paper on which an image has been formed by the image forming means is characterized by a rotation speed of a heating roller and a pressure roller that constitute the fixing mechanism portion being variably controlled based on a size of the sheet of paper to be printed, a paper pass-through direction, and a number of sheets to be printed. In this case, the variable control of a rotation speed of the heating roller and the pressure roller is based on an occurrence of a pass-through area and a non-pass-though area of a sheet of paper with respect to a roller lengthwise direction (axial direction) of a position at which the sheet of paper passes between the heating roller and the pressure roller, and is based on a thermal expansion coefficient of a roller diameter of the non-pass-though area. Specifically, a table showing correspondence between a surface temperature and a thermal expansion of the pressure roller is used, and the surface temperature of the pressure roller is respectively detected at the pass-through area and the non-pass-though area, and a thermal expansion coefficient of a roller diameter of the non-pass-though area is calculated by referencing the table based on the detected temperatures. Furthermore, depending on an input of a printing request and a printing condition, variable control of a rotation speed of the heating roller and the pressure roller is performed continually from a commencement until a completion of printing based on the table. In this case, based on a transport speed of a sheet of paper that passes through the transfer mechanism portion, a variable control width of a rotation speed of the heating roller and the pressure roller is controlled in a range expressed by a relative equation of the following formula: [(transport speed of sheet that passes through the transfer mechanism portion):(variable width of rotation speeds of the heating roller and the pressure roller)=1.0:(0.95 to 1.02)]. Further still, a drive member for sheet transport arranged at an upstream side in a paper transport direction of the fixing mechanism portion is controlled at an equivalent speed to a paper transport speed of the fixing mechanism portion in accordance with a variability of a paper transport speed of the fixing mechanism portion.

With such a control method, even in the case of successive printing, the transport speed of the sheet of recording paper due to the transfer mechanism portion and the transport speed of the sheet of recording paper due to the fixing mechanism portion can always be kept at the same speed ratio from the commencement until the completion of printing. Accordingly, it is possible form excellent images without transfer misalignment at the trailing edge area of the sheets of recording paper even when performing continuous printing with small-size sheets.

BRIEF DESCRIPTION OF THE DRAWINGS

FIG. 6A is a table showing investigation results of printing conditions when successive printing of 50 sheets is carried out with a conventional control method when the peripheral roller speed ratio of the transfer roller and the fixing rollers is controlled at a fixed ratio from the beginning of printing until the completion of printing, and FIG. 6B is a table showing investigation results of printing conditions when successive printing of 50 sheets is carried out by changing the peripheral roller speed ratio of the transfer roller and the fixing rollers in accordance with the three varieties of control data shown in FIG. 5.

DESCRIPTION OF THE PREFERRED EMBODIMENTS

Hereinafter, embodiments of the present invention will be described with reference to the accompanying drawings. These embodiments will be described with regard to a case in which the image forming apparatus of the present invention is applied to a compound machine in which a buildup system is used.

1. Description of the Overall Configuration of the Compound Machine

Figure 1:
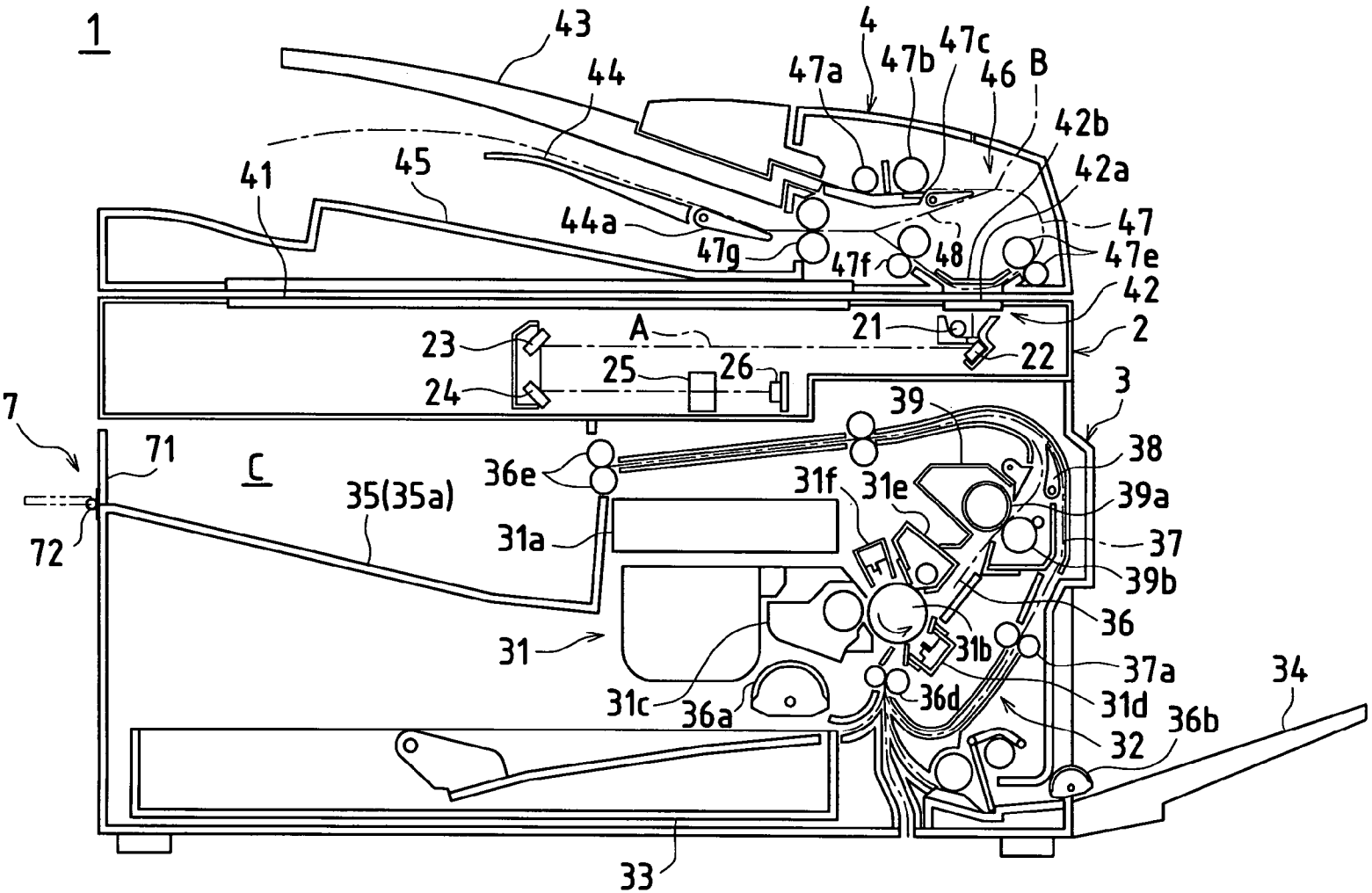
FIG. 1 is an outline drawing showing an internal structure of a compound machine as an image forming apparatus according to the present invention.

FIG. 1 shows an outline of the internal structure of a compound machine 1 as an image forming apparatus according to the present embodiment. The compound machine 1 has a copy mode, a printer mode, and a fax mode as image-forming modes in which an image is formed on a sheet of recording paper (which includes recording media such as OHP), with these modes being selected by the user.

The compound machine 1 is provided with an image-forming portion 3 that has a paper transport system 32 that stores and transports the sheets of recording paper at a lower side of the device and an image-forming system 31 directly above this, while at an upper side of the device it is provided with a scanner portion 2 as a document reading portion and an automatic paper-supply portion 4 for documents that supplies documents. The following is a description of the components therein.

1-1. Description of Scanner Portion 2

The scanner portion 2 reads images such as an image of a document placed on a document table 41 made of a material such as transparent glass and images of documents supplied sheet by sheet by the automatic paper-supply portion 4 for documents, and generates image data. The scanner portion 2 is provided with an exposure light source 21, a plurality of reflectors 22, 23, and 24, an imaging lens 25, and a photoelectric transducer (CCD: Charge Coupled Device) 26.

The exposure light source 21 irradiates light toward a document placed on the document table 41 of the automatic paper-supply portion 4 for documents or documents transported by the automatic paper-supply portion 4 for documents. The reflectors 22, 23, and 24 are configured such that, as with the light path shown by the dash-dotted line A in FIG. 1, after light reflected once from the document is reflected in a leftward direction in the drawing, it is reflected downwards, then reflected rightwards in the drawing towards the imaging lens 25.

When a document is placed on the document table 41 as an image reading operation of the document (when used as a "fixed sheet system"), the exposure light source 21 and the reflectors 22, 23, and 24 scan horizontally along the document table 41 and read an image of the entire document. On the other hand, when reading a document transported by the automatic paper-supply portion 4 for documents (when used as a "sheet movement system") the exposure light source 21 and the reflectors 22, 23, and 24 are fixed in the position shown in FIG. 1, and the document reading portion 42 of the automatic paper-supply portion 4 for documents, which is to be described later, reads the images while the document passes through.

The light that is reflected by the reflectors 22, 23, and 24 and passes through the imaging lens 25 is guided by the photoelectric transducer 26, and the reflected light is transformed by the photoelectric transducer 26 into an electric signal (document image data).

1-2. Description of Image-Forming Portion 3

The image-forming portion 3 is provided with the image-forming system 31 and the paper transport system 32.

The image-forming system 31 is provided with a laser scanning unit 31*a* and a photosensitive drum 31*b* as a drum-type image-supporting structure. Based on document image data converted by the photoelectric transducer 26, the laser scanning unit 31*a* irradiates a laser light onto a surface of the photosensitive drum 31*b*. The photosensitive drum 31*b* rotates in the direction shown by the arrow in FIG. 1 and an electrostatic latent image is formed on the surface thereof by the irradiation of laser light from the laser scanning unit 31*a*.

Furthermore, in addition to the laser scanning unit 31*a*, a development apparatus (development mechanism portion) 31*c*, a transfer unit (transfer mechanism portion) 31*d*, a cleaning apparatus (cleaning mechanism portion) 31*e*, an unshown electricity remover, and a charging unit 31*f* are circumferentially arranged in order around the periphery of the photosensitive drum 31*b*. The development apparatus 31*c* uses toner (a substance for forming a manifest image) to develop the electrostatic latent image formed on the surface of the photosensitive drum 31*b* into a visible image. The transfer unit 31*d* transfers the toner image formed on the surface of the photosensitive drum 31*b* to the sheet of recording paper, which is a recording medium. The cleaning apparatus 31*e* removes toner that is residual on the surface of the photosensitive drum 31*b* after toner transfer. The electricity remover removes electric charges that are residual on the surface of photosensitive drum 31*b*. The charging unit 31*f* charges the surface of the photosensitive drum 31*b* to a predetermined electric potential prior to the forming of the electrostatic latent image.

In this way, when forming an image on a sheet of recording paper, the surface of the photosensitive drum 31*b* is charged to a predetermined electric potential by the charging unit 31*f* and the laser scanning unit 31*a* irradiates a laser light onto the surface of the photosensitive drum 31*b* based on the document image data. After this, the development apparatus 31*c* uses toner to develop a visible image on the surface of the photosensitive drum 31*b*, and the toner image is transferred to the sheet of recording paper by the transfer unit 31*d*. Further still, after this, toner that is residual on the surface of the photosensitive drum 31*b* is removed by the cleaning apparatus 31*e* and electric charges that are residual on the surface of the photosensitive drum 31*b* are removed by the electricity remover. This completes one cycle of an operation of forming an image on a sheet of recording paper (a printing operation). By repeating this operation it is possible to carry out continuous image forming with respect to a plurality of sheets of recording paper.

On the other hand, the paper transport system 32 transports sheets of recording paper stored in a paper cassette 33 as a paper storage portion, or sheets of recording paper placed one by one on a manual loading tray 34, for image forming to be carried out by the image-forming system 31 and also discharges sheets of recording paper on which an image has been formed to a paper discharge tray 35 as a paper discharge portion.

The paper transport system 32 is provided with a main transport path 36 and a reverse transport path 37. One end of the main transport path 36 branches into two, with the end of one branch facing toward a discharge side of the paper cassette 33 and the end of the other branch facing toward a discharge side of the manual loading tray 34. Furthermore, the other end of the main transport path 36 faces toward the paper discharge tray 35. As for the reverse transport path 37, one end is connected to the main transport path 36 upstream (lower side in the drawing) from the arranged position of the transfer unit 31*d*, and connected to the main transport path 36 downstream (upper side in the drawing) from the arranged position of the transfer unit 31*d*.

A pickup roller 36*a* that is semicircular in profile is arranged at a branch of one end of the main transport path 36 (a portion facing a discharge side of the paper cassette 33). The sheets of recording paper stored in the paper cassette 33 are able to be intermittently supplied to the main transport path 36 sheet by sheet due to the rotation of the pickup roller 36*a*. Similarly, a pickup roller 36*b* that is semicircular in profile is arranged at a branch of the other end of the main transport path 36 (a portion facing a discharge side of the manual loading tray 34). The sheets of recording paper stored in the manual loading tray 34 are able to be intermittently supplied to the main transport path 36 sheet by sheet due to the rotation of the pickup roller 36*b*.

A register roller 36*d* is arranged upstream from the arranged position of the transfer unit 31*d* in the main transport path 36. The register roller 36*d* aligns the positioning of the toner image on the surface of the photosensitive drum 31*b* and the sheet of recording paper while transporting the sheets of recording paper.

Furthermore, a sheet detector 36*c* that detects edge areas of the sheets of recording paper that are transported through is arranged further upstream from the arranged position of the register roller 36*d* and downstream from the branches of the main transport path 36. The sheet detector 36*c* serves the role of a double-feed detection means for detecting double-feeding of the sheets of recording paper, which will be described later, and the role of a trailing edge detection means for detecting the trailing edge of a sheet of recording paper.

The fixing device (fixing mechanism portion) 39, which is provided with a pair of fixing rollers (the heating roller 39*a* and the pressure roller 39*b*) for fixing the transferred toner image to the sheet of recording paper using heat is arranged downstream from the arranged position of the transfer unit 31*d* in the main transport path 36. Further still, a discharge roller 36*e* for discharging the sheets of recording paper to the paper discharge tray 35 is arranged at the downstream end of the main transport path 36.

A branch catch 38 is arranged at a connection position on an upstream end of the reverse transport path 37 facing the main transport path 36. The branch catch 38 is configured to be freely rotatable around a horizontal axis between a first position shown by a solid line in FIG. 1 and, rotating in a counter clockwise direction in the drawing from the first position, a second position opening the reverse transport path 37. When the branch catch 38 is at the first position, the sheets of recording paper are transported toward the paper discharge tray 35, and when it is at the second position, the sheets of recording paper can be supplied to the reverse transport path 37. A transport roller 37*a* is arranged at the reverse transport path 37 and when a sheet of recording paper is supplied to the reverse transport path 37 (when a sheet of recording paper is supplied to the reverse transport path 37 by so-called switchback transport), the sheet of recording paper is transported by the transport roller 37*a*, then the sheet of recording paper is reversed on an upstream side of the register roller 36*d* such that it is again transported in the main transport path 36 toward the transfer unit 31*d*. That is, it is handled such that image formation can be carried out on the reverse side of the sheet of recording paper.

It should be noted that the above-described structure of the image-forming portion 3, including the paper cassette 33, manual loading tray 34, the pickup rollers 36*a* and 36*b*, the sheet detector 36*c*, and the register roller 36*d*, is hereafter also referred to as a recording-sheet supply portion.

1-3. Description of Automatic Paper-Supply Portion 4 for Documents

The following is a description of the automatic paper-supply portion 4 for documents. The automatic paper-supply portion 4 for documents is configured as a so-called automatic two-sided document transport device. The automatic paper-supply portion 4 for documents can be used as a sheet movement system and is provided with a document tray 43 as a document placement portion, a middle tray 44, a document discharge tray 45 as a document discharge portion, and a document transport system 46 that transports documents between the trays 43, 44, and 45.

The document transport system 46 is provided with a main transport path 47 for transporting documents placed on the document tray 43 to the middle tray 44 via the document reading portion 42 or the document discharge tray 45, and a secondary transport path 48 for supplying documents on the middle tray 44 to the main transport path 47.

A document pickup roller 47*a* and a stacking roller 47*b* are arranged at an upstream end (a portion facing the discharge side of the document tray 43) of the main transport path 47. A stacking board 47*c* is arranged below the stacking roller 47*b* and, due to the rotation of the document pickup roller 47*a*, one sheet of the documents on the document tray 43 passes between the stacking roller 47*b* and the stacking board 47*c* such that it is supplied to the main transport path 47. PS rollers 47*e* are arranged on a side lower than the linking area between the main transport path 47 and the secondary transport path 48 (area B in the drawing). The PS rollers 47*e* regulate the leading edge of the document and the image reading timing of the scanner portion 2 to supply documents to the document reading portion 42. That is, the PS rollers 47*e* temporarily stop the transport of the document in the state in which the document was supplied, and regulates this timing to supply documents to the document reading portion 42.

The document reading portion 42 is provided with a platen glass 42*a* and a document pressing board 42*b* and, when a document supplied from the PS rollers 47*e* passes through between the platen glass 42*a* and the document pressing board 42*b*, light from the above-mentioned exposure light source 21 passes through the platen glass 42*a* and is irradiated on the document. At this juncture, document image data is obtained by the above-mentioned scanner portion 2. A biasing force is applied to the back surface (top surface) of the document pressing board 42*b* by an unshown coil spring. In this way, the document pressing board 42*b* makes contact against the platen glass 42*a* with a predetermined suppressing force, thus preventing the document from rising up from the platen glass 42*a* when the document passes through the document reading portion 42.

Transport rollers 47*f* and document discharge rollers 47*g* are provided on a downstream side of the platen glass 42*a*. A document that passes over the platen glass 42*a* is discharged to the middle tray 44 or the document discharge tray 45 via the transport rollers 47*f* and the document discharge rollers 47*g*.

A middle tray swinging board 44*a* is arranged between the document discharge rollers 47*g* and the middle tray 44. The middle tray swinging board 44*a* has its swinging center at an edge area of the middle tray 44 and is able to swing between a position 1 shown in the drawing by a solid line and a position 2 in which it is raised upwards from the position 1. When the middle tray swinging board 44*a* is in the position 2, a document discharged from the document discharge rollers 47*g* is withdrawn to the document discharge tray 45. On the other hand, when the middle tray swinging board 44*a* is in the position 1, a document discharged from the document discharge rollers 47*g* is discharged to the middle tray 44. When a document is discharged to the middle tray 44, an edge of the document is put into a sandwiched condition between the document discharge rollers 47*g*, and by reversing the rotation of the document discharge rollers 47*g* while in this condition, the document is supplied to the secondary transport path 48 and is again dispatched to the main transport path 47 via the secondary transport path 48. The operation of reversing the rotation of the document discharge rollers 47*g* is carried out by regulating the dispatch of the document to the main transport path 47 and the timing of image reading. In this way, an image on the reverse side of a document can be read by the document reading portion 42.

2. Description of the Basic Operation of the Compound Machine

As an operation of the compound machine 1 configured as described above, firstly, when the compound machine 1 functions as a printer (printer mode), print data (image data, text data, etc.) that is sent from a host device such as a personal computer is received and the received print data is temporarily stored in an unshown buffer (memory). Along with the storage of print data to the buffer, print data is read out from the buffer in order and, based on the print data that is read out, an image is formed on a sheet of recording paper by an image forming operation of the above-described image-forming portion 3.

Furthermore, when the compound machine 1 functions as a scanner (FAX mode), the scanned image data of the document read by the above-described scanner portion 2 is temporarily stored in the buffer. Along with the storage of scanned image data to the buffer, the scanned image data is sent from the buffer to the host device in order, and an image is displayed on a display or the like of the host device.

Further still, when the compound machine 1 functions as a copying machine (copier mode), an image is formed on a sheet of recording paper by an image forming operation of the image-forming portion 3 based on the document image data that is read by the above-mentioned scanning function.

The following is a more detailed description of copier mode.

2-1. Description of an Image Forming Operation in Copier Mode

When copying an image of a document onto a sheet of recording paper in copier mode, the document to be copied is placed on the document table 41 or the document tray 43 of the scanner portion 2, after which settings such as the number of sheets to be printed and the printing magnification ratio are input by pressing various input keys provided on an unshown operation panel portion, then the copying operation begins with the pressing of an unshown start key.

When the start key of the compound machine 1 is pressed, the pickup roller 36*a* or 36*b* rotates to supply a sheet of recording paper to the main transport path 36 from the paper cassette 33 or the manual loading tray 34. The supplied sheet of recording paper is transported by the register roller 36*d* arranged at the main transport path 36. In order to be positionally aligned with the toner image formed on the photosensitive drum 31*b* that is to carry out the transfer to the recording paper, the leading edge area in the transport direction of the sheet of recording paper that is transported by the register roller 36*d* is clamped by the register roller 36*d* such that the sub-scanning direction of the sheet of recording paper and the axial direction of the register roller 36*d* become parallel.

The image data read by the scanner portion 2 undergoes image processing under conditions input by input keys or the like and is then sent to a laser scanning unit (LSU) 31*a* as print data. The LSU 31*a* forms an electrostatic latent image on the surface of the photosensitive drum 31*b*, which is charged to a predetermined electric potential by the charger 31*f*, by irradiating laser light based on the image data via an unshown polygon mirror and various lens.

After this, a toner image that is adhering to the surface of an MG roller 31*c*1 facing the photosensitive drum 31*b* and provided in an unshown development vessel of the development apparatus 31*c* is attracted and becomes adhered to the surface of the photosensitive drum 31*b* in response to an electric potential gap on the surface of the photosensitive drum 31*b* such that the electrostatic latent image is made to become a manifest image. Toner that is residual on the photosensitive drum 31*b* is scraped away by an unshown drum unit cleaning blade and collected by an unshown cleaner unit.

Following this, the positions of the sheet of recording paper being fastened by the register roller 36*d* and the toner image formed on the surface of the photosensitive drum 31*b* are aligned (the timing thereof is adjusted) by the register roller 36*d*, and the sheet of recording paper is transported between the photosensitive drum 31*b* and the transfer unit 31*d*. Then, the toner image on the surface of the photosensitive drum 31*b* is transferred to the sheet of recording paper using an unshown transfer roller provided in the transfer unit 31*d*.

The sheet of recording paper on which a transfer of a toner image has been completed is subjected to heat and pressure by being passed between the heating roller 39*a* and the pressure roller 39*b* of the fixing device 39 and is discharged to the paper discharge tray 35 by the discharge roller 36*e* with the toner image thereon fused and fastened.

3. Description of Block Diagram Structure of Control System

Figure 2:
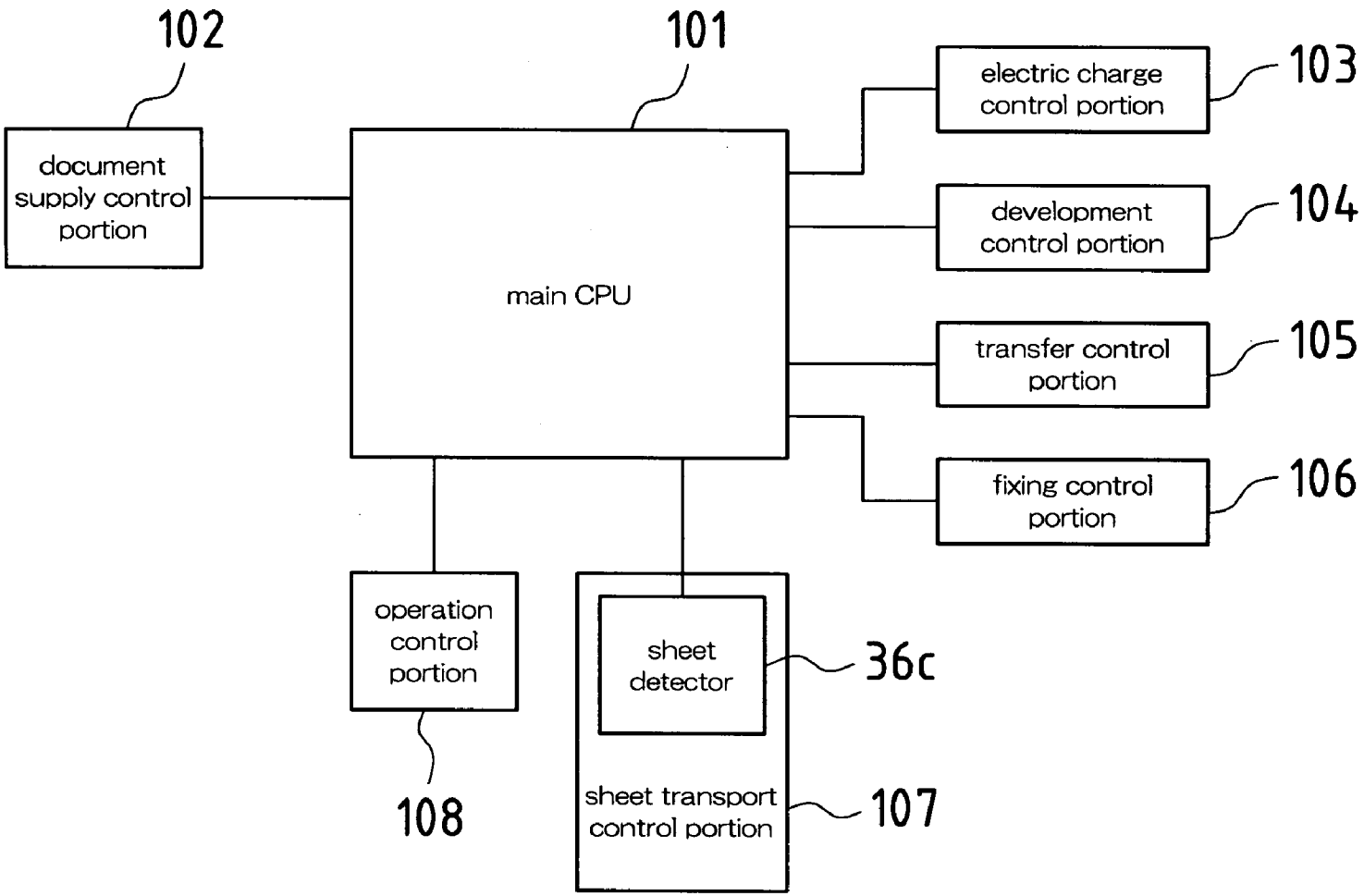
FIG. 2 is a functional block diagram showing the structure of a control system of a compound machine of the present embodiment.

FIG. 2 is a functional block diagram showing the structure of the control system of the compound machine 1.

A main CPU 101 is provided in the compound machine 1 in order to comprehensively control the various devices mounted therein (the scanner portion 2, the image-forming portion 3, and the automatic paper-supply portion 4 for documents), and bi-directionally connected in the main CPU 101 are a document supply control portion 102 that controls the automatic supply of documents, a electric charge control portion 103 that controls the various portions of the image-forming portion 3, a development control portion 104, a transfer control portion 105, a fixing control portion 106, and a sheet transport control portion 107 provided with a sheet detector 36*c* for detecting an end area of the sheets.

Furthermore, also connected to the main CPU 101 is an operation control portion 108 at which a user carries out input operations to output a signal from an unshown operation panel portion, and at which a display operation is carried out on the operation panel portion in response to a signal from the main CPU 101.

Figure 8:
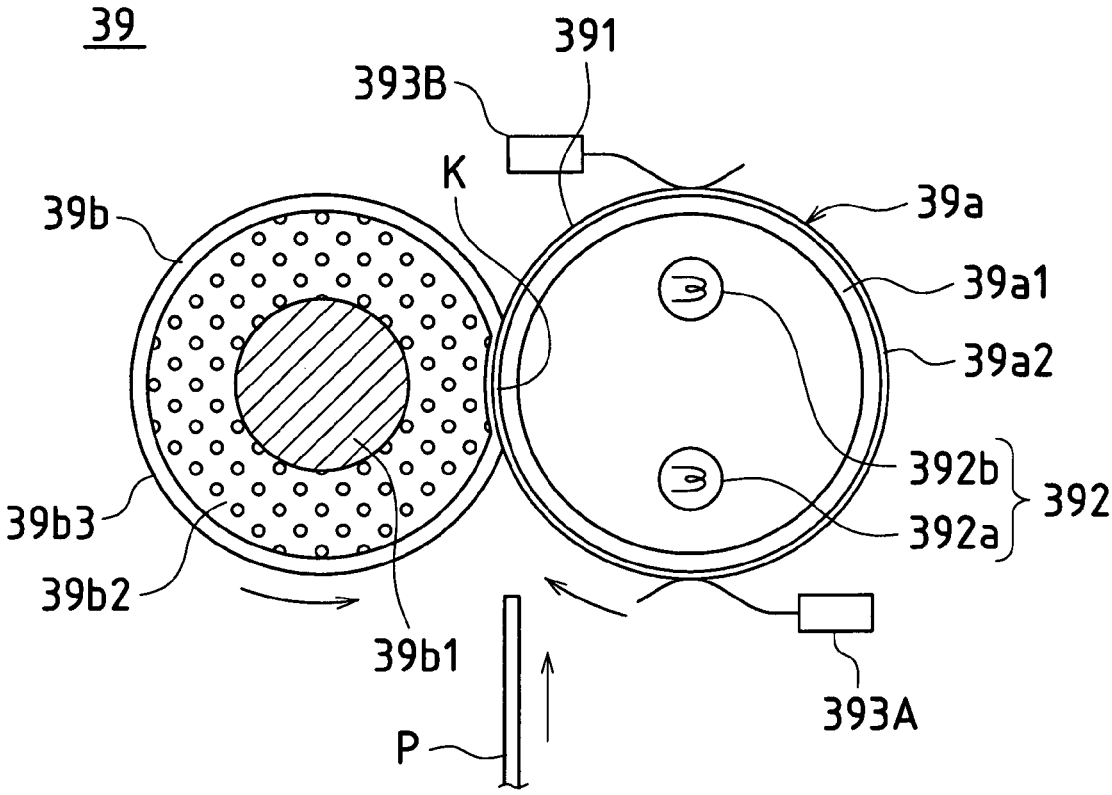
FIG.8 Prior Art
FIG. 8 is a diagram of an internal configuration of conventional fixing rollers as viewed from the axial direction of the rollers.
Figure 9:
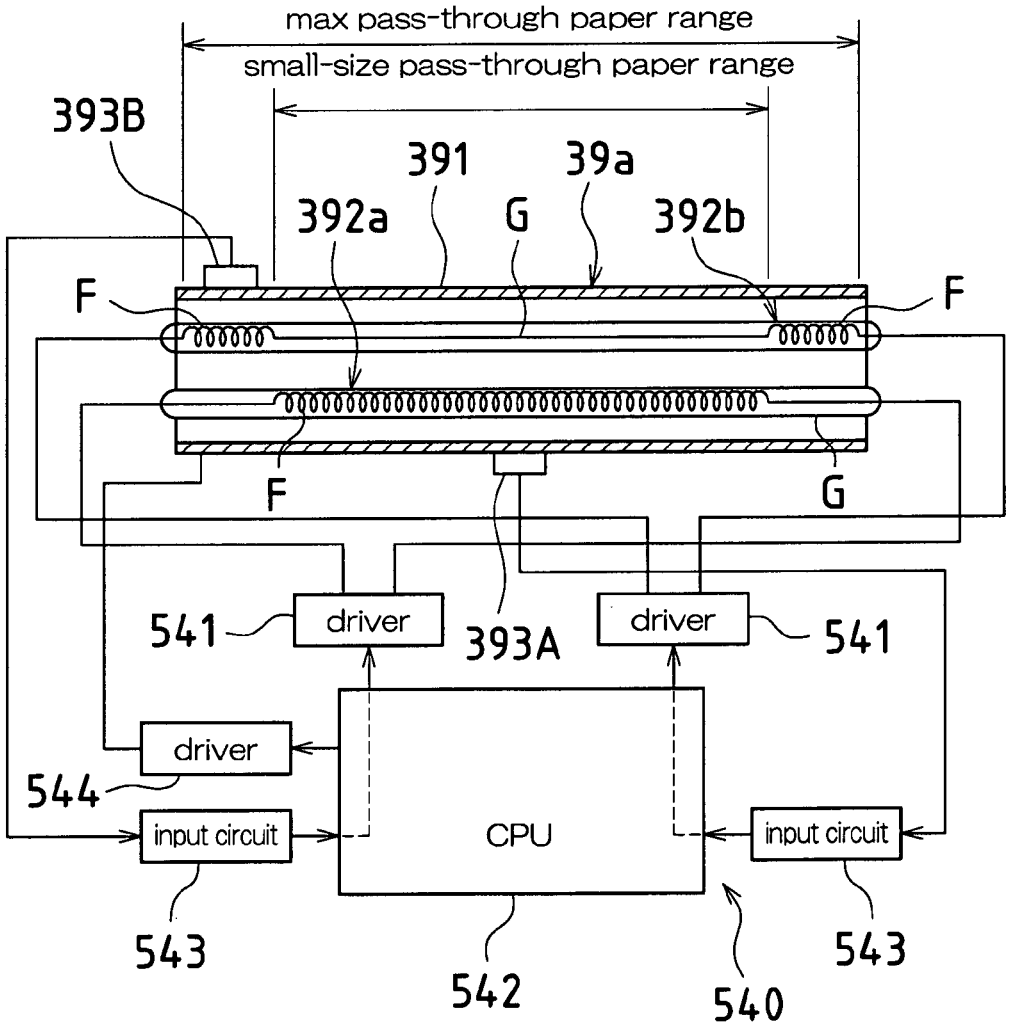
FIG.9 Prior Art
FIG. 9 is an explanatory diagram showing an overall configuration of conventional fixing rollers and a configuration of a control circuit therein.
Figure 10:
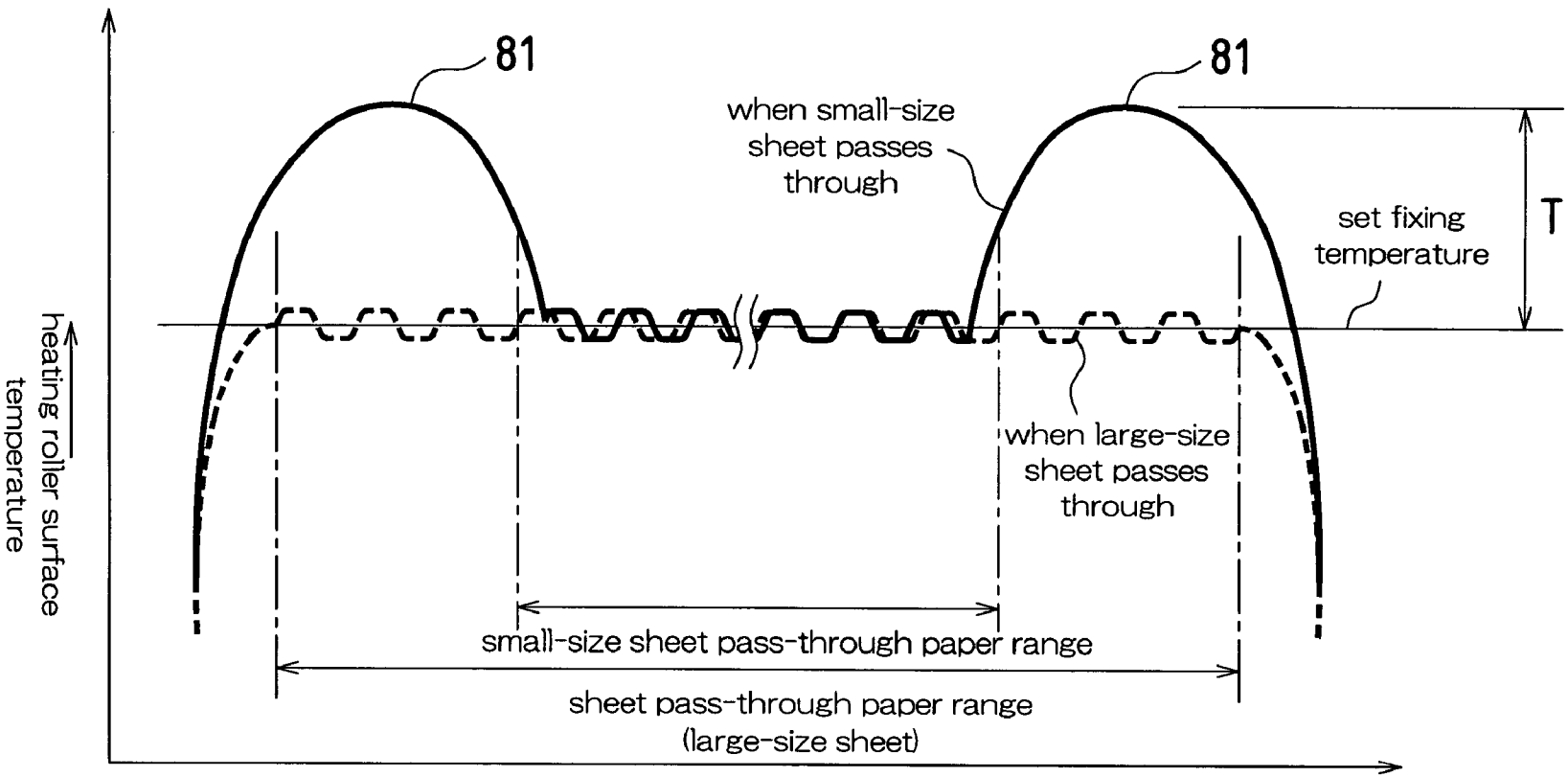
FIG.10 Prior Art
FIG. 10 is an explanatory diagram showing an example of temperature distribution of a heating roller in the axial direction.
Figure 11:
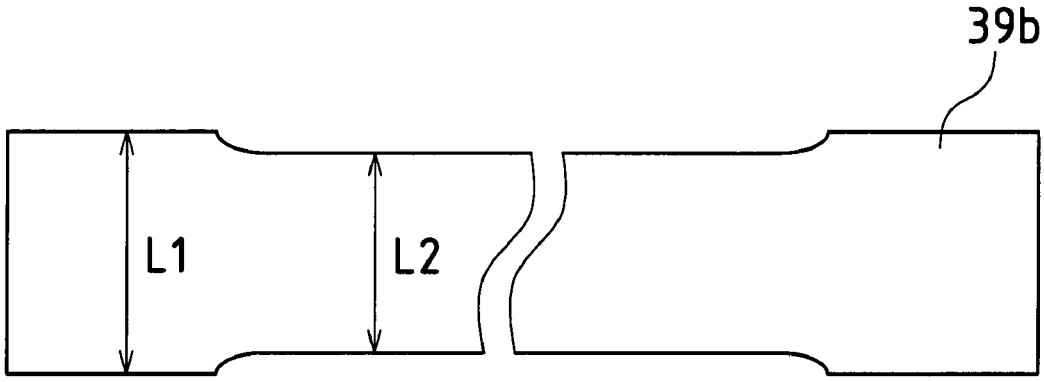
FIG.11 Prior Art
FIG. 11 is a diagram for describing diameter variation in a central area (paper pass-through area) and side areas (paper non-pass-through areas) caused by differences in thermal expansion of the pressure roller itself.
Figure 12A:
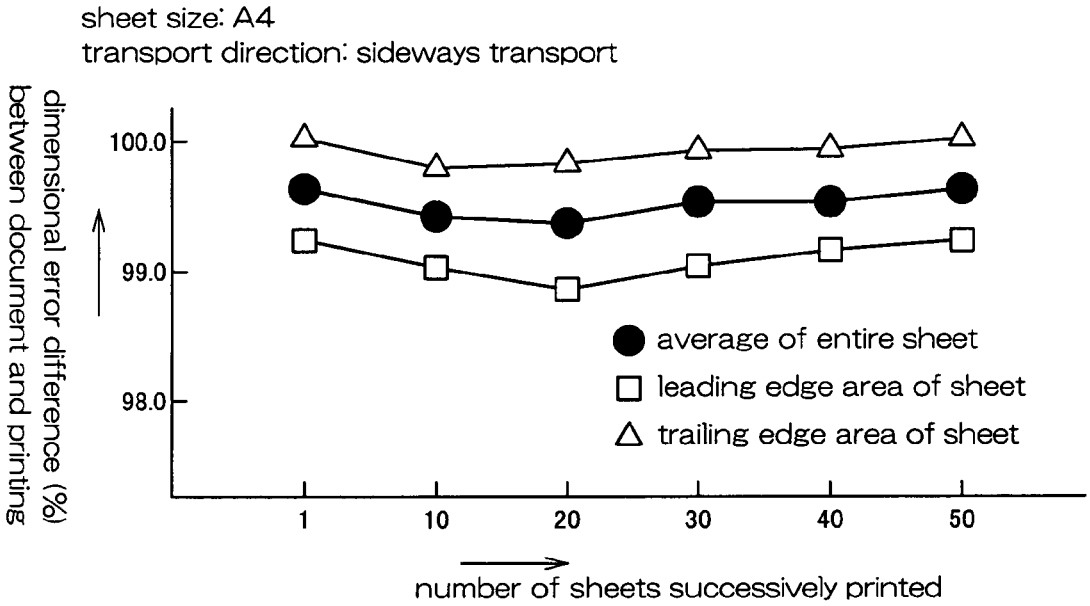
FIG.12 A Prior Art
FIG. 12 shows test results regarding the extent of change in paper transport speeds during the fixing process in successive printing, with FIG. 12A being the test results for when A4-size sheets of recording paper were transported sideways and FIG. 12B being the test results for when A4-size sheets of recording paper where transported lengthwise.
Figure 12B:
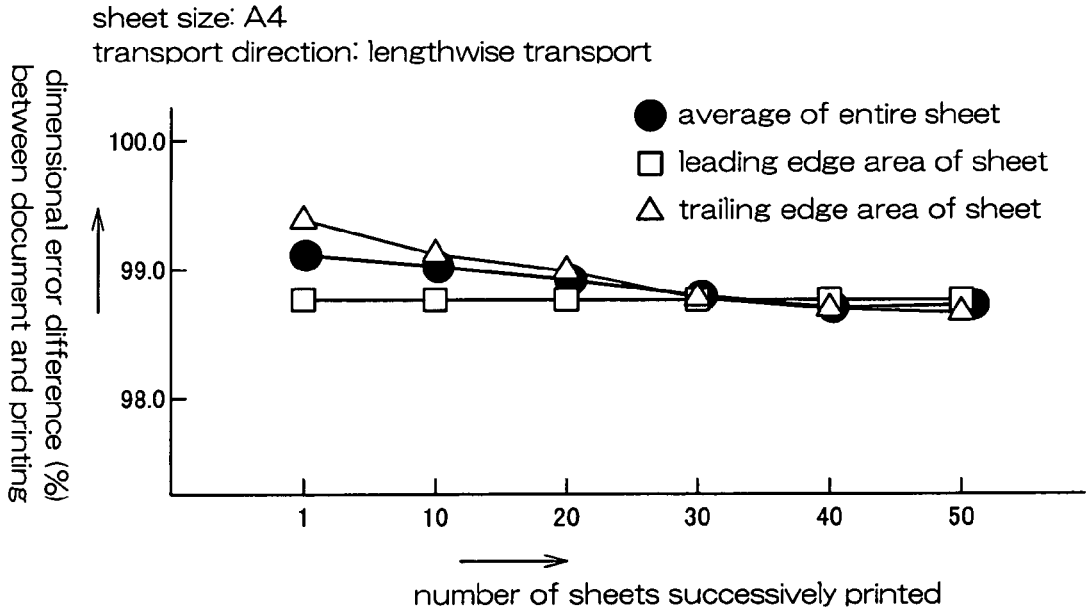
FIG.12 B Prior Art

In the above-described configuration, the fixing control portion 106 corresponds to the control circuit 540 shown in FIG. 9. Furthermore, in the present embodiment, the structure of the fixing device (fixing mechanism portion) 39 is the same as the structure shown in FIGS. 8 and 9.

This has been an overall description of a compound machine.

In regard to the above-described structure of the compound machine, conventionally control of the rotational speed (fixing roller rotation speed) of the fixing rollers (the heating roller 39*a* and the pressure roller 39*b*) during a printing operation is controlled without considered of thermal expansion of the pressure roller 39*b*, however, in the present embodiment, the rotation speed of the fixing rollers is controlled with consideration given to thermal expansion of the pressure roller 39*b*. For this reason, in the present embodiment, temperature detection sensors for detecting the surface temperature of the paper pass-through area and the paper non-pass-through area of the pressure roller 39*b* are respectively arranged at the paper pass-through area and the paper non-pass-through area.

Figure 3:
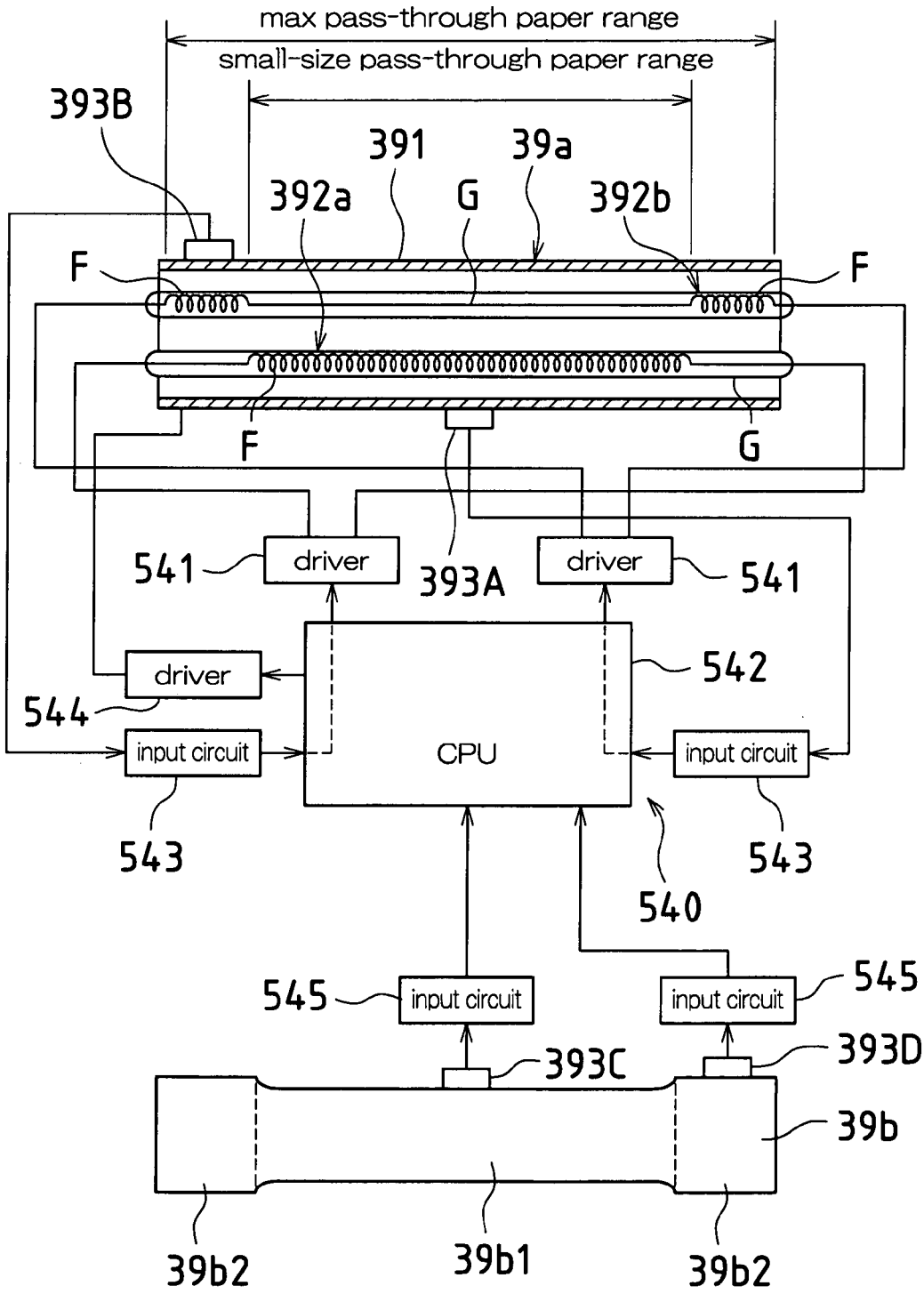
FIG. 3 is an explanatory diagram showing an overall configuration of the fixing rollers according to the present embodiment and a configuration of a control circuit therein.

FIG. 3 shows an overall configuration of the fixing rollers according to the present embodiment and a configuration of a control circuit therein.

As shown in FIG. 3, in the present embodiment, in addition to the conventional structure shown in FIG. 9, temperature sensors 393C and 393D are arranged for detecting the respective surface temperatures of a paper pass-through area 39*b*1 and a paper non-pass-through area 39*b*2 of the pressure roller 39*b*, the output of the temperature sensors 393C and 393D is connected to a CPU 542 via respective input circuits 545. Other areas of the configuration are the same as the configuration shown in FIG. 9, and therefore the same numerical symbols are used here with same components and detailed description is omitted.

In this regard, the rotation speeds of the heating roller 39*a* and the pressure roller 39*b* are variably controlled by the CPU 542 based on the sheet size to be printed, the direction the sheet is to be passed, and the number of printed sheets.

In the present embodiment, variable control of the rotation speeds of the heating roller 39*a* and the pressure roller 39*b* by the CPU 542 is based on a thermal expansion coefficient of a roller diameter of the paper non-pass-through area 39*b*2 of the pressure roller 39*b* on the basis of the occurrence of the paper pass-through area 39*b*1 and the paper non-pass-through area 39*b*2 of the sheets of recording paper due to the positions at which the sheets of recording paper pass through the heating roller 39*a* and the pressure roller 39*b* with respect to the lengthwise direction (axial direction) of the rollers.

Specifically, the correspondence between the surface temperature and the thermal expansion of the pressure roller 39*b* is obtained in advance by tests or the like, and a thermal expansion table that expresses this correspondence is stored in advance. Since the scientific properties of thermal expansion are constant depending on the material used for the pressure roller 39*b*, the correspondence between the surface temperature and the thermal expansion easily can be obtained in tests or the like.

By detecting the respective surface temperatures of the pressure roller 39*b* at the paper pass-through area 39*b*1 and the paper non-pass-through area 39*b*2 and referencing the thermal expansion table on the basis of the detected temperatures, the CPU 542 calculates the thermal expansion coefficient of the roller diameters of the paper pass-through area 39*b*1 and the paper non-pass-through area 39*b*2. Then, in consideration of roller diameter variation of the paper non-pass-through area 39*b*2 due to differences in the calculated thermal expansion coefficients, the rotation speeds of the heating roller 39*a* and the pressure roller 39*b* are variably controlled so as to be constant for example. Depending on the input of printing requests and printing conditions to the device, this variable control is performed continually from the beginning of printing until the completion of printing based on the thermal expansion table. In this case, based on the transport speed of the sheet of recording paper that passes through the transfer unit (transfer mechanism portion) 31*d*, the variable control width of the rotation speeds of the heating roller 39*a* and the pressure roller 39*b* is given as the range expressed by the relative equation in the following formula (1):

(transport speed of sheet that passes through the transfer mechanism portion):(variable width of rotation speeds of the heating roller and the pressure roller)=1.0:(0.95 to 1.02) (1)

In this way, even in the case of successive printing, the transport speed of the sheet of recording paper due to the transfer unit 31*d* and the transport speed of the sheet of recording paper due to the fixing rollers (the heating roller 39*a* and the pressure roller 39*b*) of the fixing device (fixing mechanism portion) 39 can always be kept at the same speed ratio from the beginning of printing until the completion of printing. Accordingly, it is possible form excellent images without transfer misalignment at the trailing edge area of the sheets of recording paper even when performing successive printing with small-size sheets.

In this case, a drive member for sheet transport arranged at an upstream side in the paper transport direction of the fixing device 39 (for example, the discharge roller 36*e* or a finisher drive source when a finisher is attached as an option) is also controlled to the same speed as the transport speed of the fixing device 39. Thus, the sheets of recording paper are not bent while they are being transported to the discharge roller 36*e* for example from the fixing device 39, and there is no risk of the sheets being rubbed by peripheral members or pulled upon.

EXAMPLE 1

The following is a more detailed description concerning a specific example, example 1, of a method for controlling the above-described fixing mechanism portion.

Note that in example 1, a control table is stored in advance in which changes in the thermal expansion coefficients of roller diameters calculated by referencing the above-mentioned thermal expansion table are converted to roller rotation speeds, with these roller rotation speeds corresponding to detected temperature differences of the temperature sensors 393C and 393D, and speed control of the fixing rollers is carried out using this control table.

Figure 4:
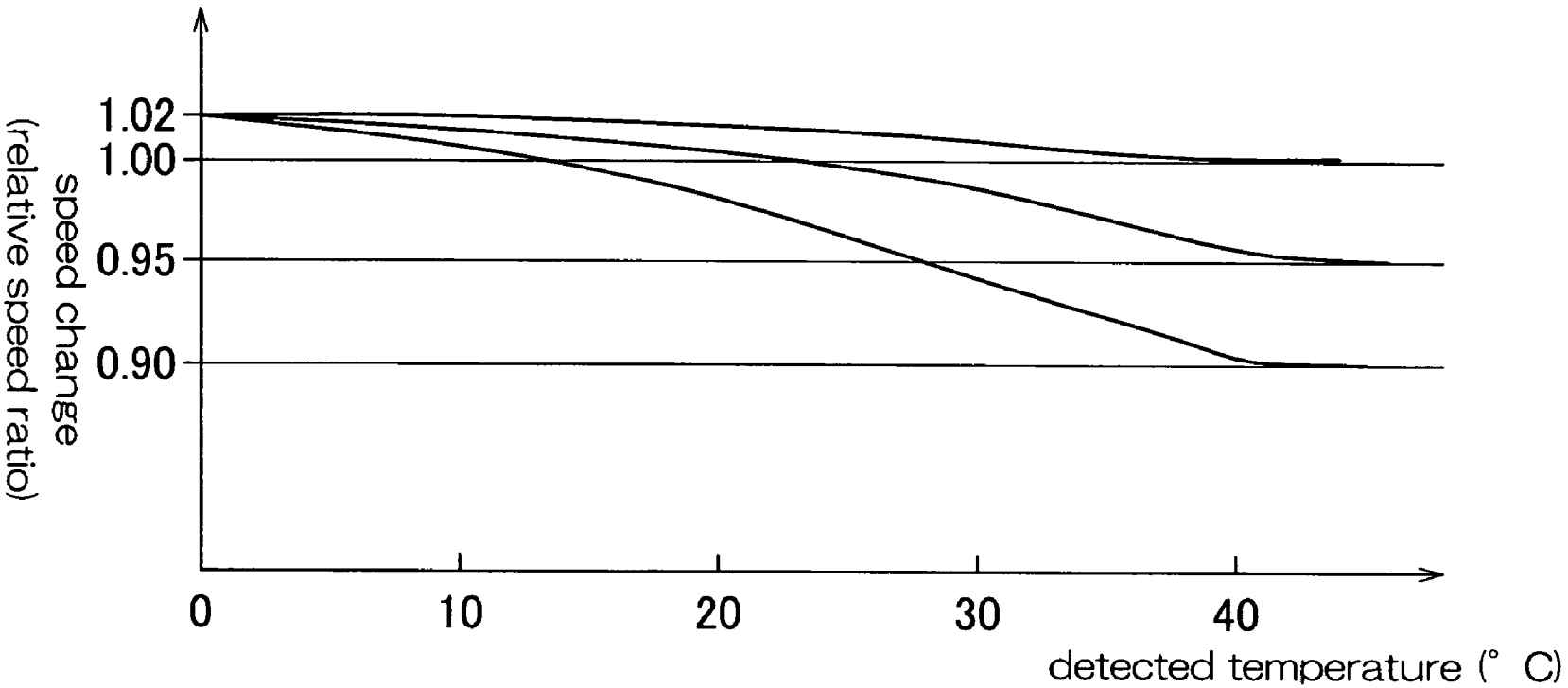
FIG. 4 is an explanatory diagram showing an example of a graph that shows the control contents of a control table.

FIG. 4 is an example showing a graph of the control contents of a control table. The control table is shown here as a graph with the vertical axis indicating the roller speed of the fixing rollers when the roller speed of the transfer roller is given as 1, and the horizontal axis indicating the temperature difference between the paper pass-through area and the paper non-pass-through areas. First control data 91 is a control example in which the relative speed of the fixing rollers is changed from 1.02 at the beginning of printing to 1.00 at the completion of printing, second control data 92 is a control example in which the relative speed of the fixing rollers is changed from 1.02 at the beginning of printing to 0.95 at the completion of printing, and third control data 93 is a control example in which the relative speed of the fixing rollers is changed from 1.02 at the beginning of printing to 0.90 at the completion of printing. However, there is no limitation to these three kinds of control examples.

Hereinafter, a method for controlling example 1 will be described with reference to the flowchart shown in FIG. 5.

When there is a print request to the device (step S1), a check is then carried out as to whether or not print conditions have been input (step S2), and if print conditions have not been input, the input of print conditions is prompted (step S3). On the other hand, if print conditions have been input, the size of the sheets of recording paper is then checked (step S4). As a result of this, when large-size sheets are to be printed such that a sheet of recording paper spans substantially the entire length of the fixing rollers when passing through (for example, when A4-size sheets of recording paper are transported sideways) (step S5), a discrepancy in thermal expansion of the heating roller 39*b* as described above does not occur, and therefore the drive speed of the fixing rollers, that is, the peripheral roller speed of the heating roller 39*a* and the pressure roller 39*b* is controlled (step S6) conventionally with a ratio (for example, 1.02 times) that is always constant with respect to the peripheral roller speed of the transfer roller, and printing processes are carried out (step S7 and step S8) until all printing is completed.

On the other hand, for sheets of recording paper that are small-size sheets (for example, when A4-size sheets of recording paper are to be transported lengthwise), the CPU 542 extracts (step S9) a preset control table from the control tables (for example, the second control table 92) in accordance with the print conditions that have been input, and carries out printing (step S10) in accordance with this control table.

In other words, in the case of successive printing, the CPU 542 checks whether or not there is printing to be carried out next (step S11), and if there is printing to be carried out next, detects the surface temperatures of the pressure roller 39*b* respectively at the paper pass-through area 39*b*1 and the paper non-pass-through area 39*b*2 based on the temperatures detected by the temperature sensors 393C and 393D, and checks (step S12) the temperature difference thereof. Then, the second control table 92 of the above-mentioned control tables is referenced based on the detected temperature differences and a check is carried out (step S13) as to whether or not the detected temperature difference is a temperature difference that requires the current peripheral roller speed of the fixing rollers (that is, the transport speed of the sheets of recording paper) to be changed.

As a result, based on the detected temperature difference, when the current peripheral roller speed is divergent from the peripheral roller speed shown in the second control data 92 above a preset fixed value (when judged "yes" at step S13), the number of steps per unit of time of an unshown stepping motor that rotational drives the fixing rollers is changed and the peripheral roller speed of the fixing rollers is changed (step S14) so as to be the peripheral roller speed shown in the second control data 92. On the other hand, based on the detected temperature difference, when the result of the check at step S13 is that the current peripheral roller speed is within a range of preset fixed values (when judged "no" at step S13) with respect to the peripheral roller speeds shown in the second control data 92, the peripheral roller speed of the fixing rollers is not changed and the procedure returns to step S11. The CPU 542 repeats these processes (the processes of step S11 to step S14) until there is no printing to be carried out next (until judged "no" at step S11).

In this way, the speed at which sheets of recording paper are transported by the fixing rollers drops until a final ratio of 0.95 relative to the transfer roller during repetitions of successive printing. That is, a sheet of recording paper that initially was pulled by the fixing rollers during transfer will not be pulled by the fixing rollers during the course of this process. In other words, even though the roller diameter of the pressure roller 39*b* expands during successive printing, the peripheral roller speed of the fixing rollers declines by that amount, and therefore the sheet of recording paper is not strongly pulled by the fixing rollers during the period in which the trailing edge area of the sheets of recording paper are being transferred by the transfer roller. Accordingly, there is no occurrence of transfer misalignment.

It should be noted that the second control table 92 was used as an example in the above description, but when using the first control table 91 in successive printing, the peripheral roller speed of the fixing rollers does not become slower than the peripheral roller speed of the transfer roller. That is, during the printing of the trailing edge area of a sheet of recording paper by the transfer roller, the sheet of recording paper is in a condition in which it is constantly pulled by the fixing rollers. However, the relative speed ratio of the fixing rollers with respect to the transfer roller gradually drops from an initial 1.02 to 1.00, and therefore the pulling force also drops. Accordingly, even toward the end of successive printing (for example, the 40th to 50th sheet), there is no occurrence of transfer misalignment.

Figure 5:
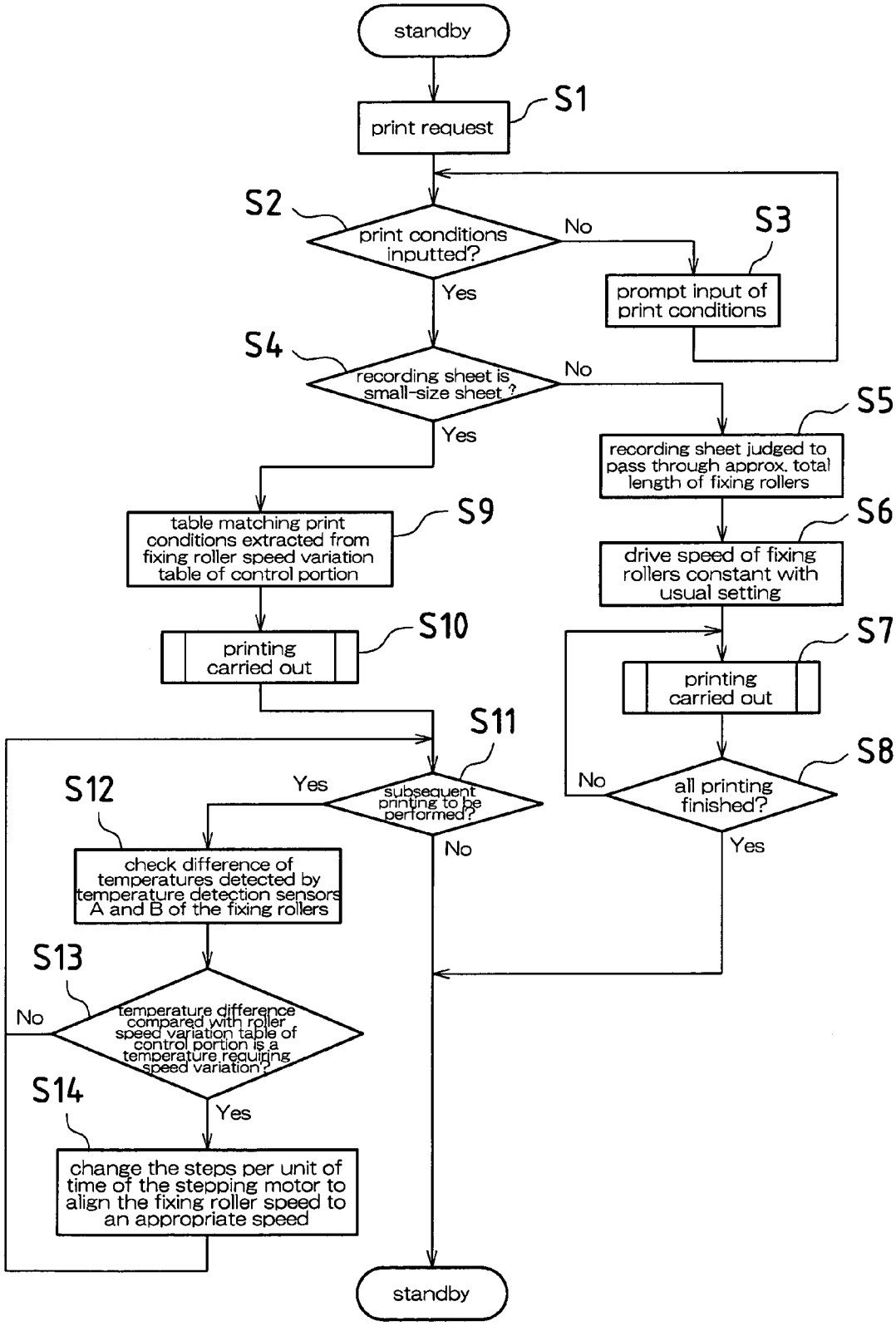
FIG. 5 is a flowchart showing a processing order of a method for controlling a fixing mechanism portion according to an example 1 of the present invention.

In this connection, FIG. 6A shows investigation results of printing conditions when successive printing of 50 sheets is carried out with a conventional control method when the peripheral roller speed ratio of the transfer roller and the fixing rollers is controlled at a fixed ratio from the beginning of printing until the completion of printing, and FIG. 6B shows investigation results of printing conditions when successive printing of 50 sheets is carried out by changing the peripheral roller speed ratio of the transfer roller and the fixing rollers in accordance with the three varieties of control data shown in FIG. 5.

In FIG. 6A, for a peripheral roller speed ratio of (1:1.02) with the conventional control method, rub-off of the print surface and smearing of trailing edge areas of the sheets is fine even after the 40th sheet, but changes in the print magnification become large at the leading edge areas and trailing edge areas such that it is "somewhat inferior (Δ)." In other words, transfer misalignment is occurring. This appears more conspicuous the larger the peripheral roller speed ratio becomes. Furthermore, for peripheral roller speed ratios of (1:1.00), (1:0.95), and (1:0.90), since the sheets of recording paper slacken, rub-off of the print surface and smearing of trailing edge areas of the sheets becomes conspicuous.

On the other hand, in FIG. 6B with the control method of the present embodiment, for the most part all the inspection items are excellent or at least ordinary for all the control data. However, with a peripheral roller speed ratio of (1:0.90), since the slackness of the sheets of recording paper increases slightly, smearing of trailing edge areas of the sheets in printing from the 40th sheet is inferior.

It should be noted that, in the above-described example 1, the configuration was such that the peripheral roller speed of the fixing rollers changed in stages by comparison with a preset fixed value, but it is also possible to perform control such that this is changed linearly in accordance with control data stored in a control table.

EXAMPLE 2

With the control method of example 1, in the case of successive printing, the peripheral roller speed of the fixing rollers is changed in stages or linearly over the entire number of printed sheets, but in example 2, the peripheral roller speed of the fixing rollers is changed during the printing of a single sheet of recording paper, during the printing of leading edge area and the during the printing of the trailing edge area.

Figure 7:
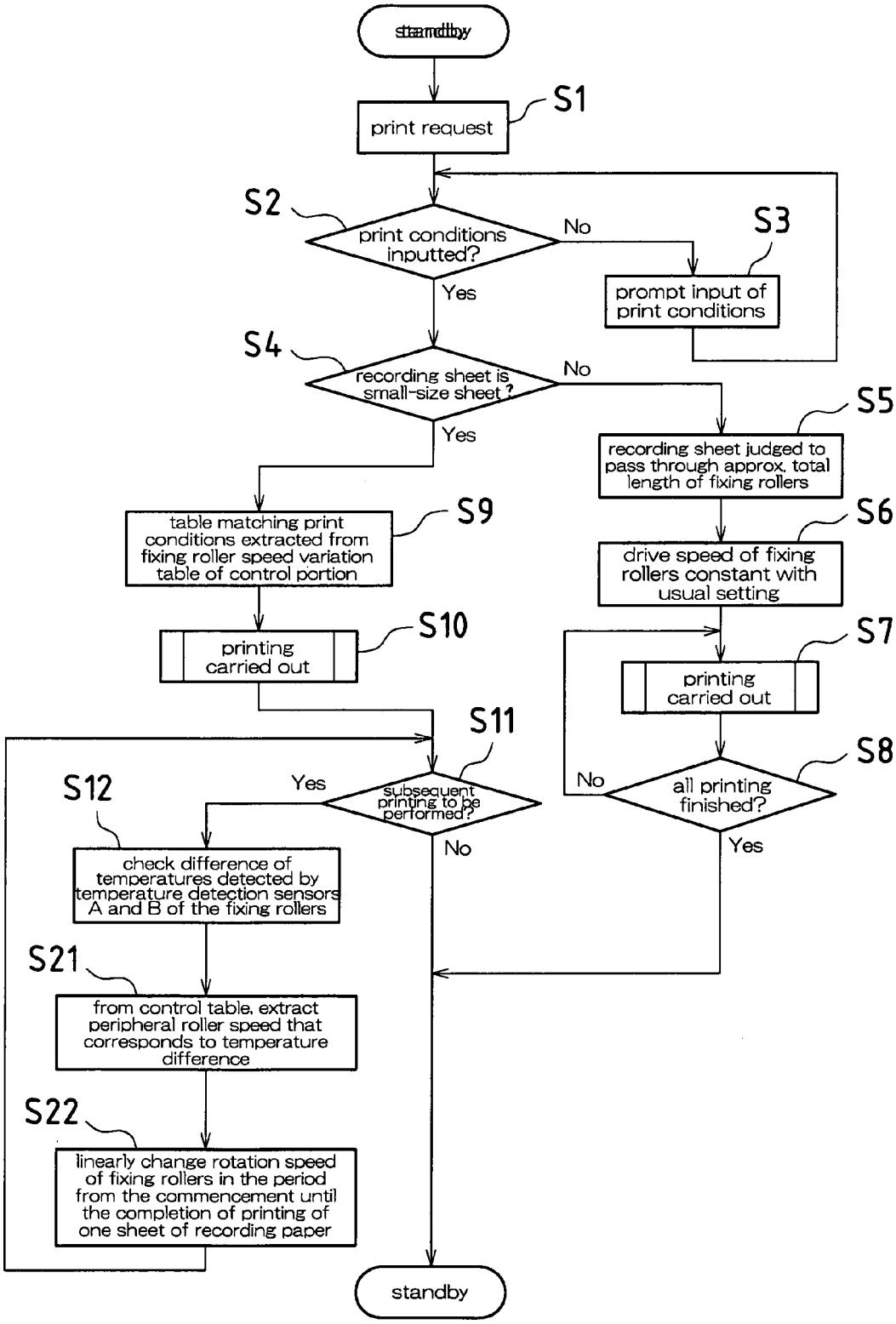
FIG. 7 is a flowchart showing a processing order of a method for controlling a fixing mechanism portion according to an example 2 of the present invention.

Hereinafter, a specific description is given with reference to the flowchart shown in FIG. 7. Note that the control tables of example 1 are also used in example 2 here. It should also be noted that the steps S1 to S12 in this drawing are the same as in the flowchart shown in FIG. 5 by which example 1 was described, and therefore the same process numbers will be used for same process steps in FIG. 7 and detailed description thereof will be omitted.

In other words, in the case of successive printing, the CPU 542 checks whether or not there is printing to be carried out next (step S11), and if there is printing to be carried out next, detects the surface temperatures of the pressure roller 39*b* respectively at the paper pass-through area 39*b*1 and the paper non-pass-through area 39*b*2 based on the temperatures detected by the temperature sensors 393C and 393D, and checks (step S12) the temperature difference thereof. Then, the second control data 92 for example of the above-mentioned control tables is referenced based on the detected temperature differences and a peripheral roller speed of the fixing rollers that corresponds to the detected temperature difference is extracted (step S21) from the second control data 92. The peripheral roller speed varies depending on the number of sheets to be printed, but here 1.00 is extracted for example.

Then, printing of the sheet of recording paper begins and at this time the CPU 542 linearly changes the peripheral roller speed of the fixing rollers from 1.02 to 1.00 during the period from the commencement of printing of the single sheet of recording paper until the completion of printing of that sheet. In this way, at the time of printing the leading edge area of the sheet of recording paper, the peripheral roller speed of the fixing rollers has a relative ratio of 1.02, and at the time of printing the trailing edge area of the same sheet of recording paper, the rotation speed of the fixing rollers drops to a relative ratio of 1.00.

In this way, by linearly changing the peripheral roller speed of the fixing rollers in the period in which data is printed on a single sheet of recording paper, extremely fine print control can be achieved for every individual sheet of recording paper, and it is possible to print very fine quality image on sheets of recording paper even in the case of successive printing.

Thus, even though the roller diameter of the pressure roller 39*b* expands during successive printing, the peripheral roller speed of the fixing rollers declines by that amount, and therefore the sheet of recording paper is not strongly pulled by the fixing rollers during the period in which the trailing edge area of the sheets of recording paper are being transferred by the transfer roller. Accordingly, there is no occurrence of transfer misalignment.

It should be noted that, in the present description, two typical examples were shown for the method for controlling a fixing mechanism portion, but the method for controlling a fixing mechanism portion according to the present invention is not limited to only these examples. That is, a characteristic of the present invention is that altered control of the rotational speed of the fixing rollers is achieved by detecting the sheet size and transport direction of the print request and the number of sheets to be printed, and various control methods are included by which transfer misalignment does not occur in the trailing edge area of sheets of recording paper during successive printing.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus provided with a paper transport means for transporting a sheet of paper, an image forming means for forming an image on the sheet of paper transported by the paper transport means, and a discharge means for discharging the sheet of paper on which an image has been formed by the image forming means, wherein the image forming means has a transfer mechanism portion that transfers the image to the sheet of paper and a fixing mechanism portion that fixes the transferred image, the image forming apparatus comprising:

a control means for variably controlling a rotation speed of a heating roller and a pressure roller that constitute the fixing mechanism portion, based on a size of the sheet of paper to be printed, a paper pass-through direction, and a number of sheets to be printed.

2. The image forming apparatus according to claim 1, wherein variable control of a the rotation speed of the heating roller and the pressure roller by the control means is based on an occurrence of a pass-through area and a non-pass-though area of a sheet of paper with respect to a roller lengthwise direction of a position at which the sheet of paper passes between the heating roller and the pressure roller, and control is based on a thermal expansion coefficient of a roller diameter of the non-pass-though area.

3. The image forming apparatus according to claim 2, wherein a table showing correspondence between a surface temperature and a thermal expansion of the pressure roller is stored in advance in the control means, and the control means respectively detects the surface temperatures of the pressure roller at the pass-through area and the non-pass-though area, and calculates a thermal expansion coefficient of a roller diameter of the non-pass-though area by referencing the table based on the detected temperatures.

4. The image forming apparatus according to claim 3, wherein, depending on an input of a printing request and printing conditions to the apparatus, variable control of the rotation speed of the heating roller and the pressure roller by the control means is performed continually from a commencement until a completion of printing based on the table.

5. The image forming apparatus according to claim 4, wherein based on a transport speed of a sheet of paper that passes through the transfer mechanism portion, a variable control width of the rotation speed of the heating roller and the pressure roller is in a range expressed by a relative equation of the following formula:

(transport speed of sheet that passes through transfer mechanism portion):(variable width of rotation speed of heating roller and pressure roller)=1.0:(0.95 to 1.02).

6. The image forming apparatus according to claim 1, wherein a drive member for sheet transport arranged at an upstream side in a paper transport direction of the fixing mechanism portion is controlled at an equivalent speed to a paper transport speed of the fixing mechanism portion in accordance with a variability of a paper transport speed of the fixing mechanism portion.

7. A method for controlling a fixing mechanism portion in an image forming apparatus provided with a paper transport means for transporting a sheet of paper, an image forming means having a transfer mechanism portion that transfers an image to the sheet of paper transported by the paper transport means and a fixing mechanism portion that fixes the transferred image, and a discharge means for discharging the sheet of paper on which an image has been formed by the image forming means;

wherein a rotation speed of a heating roller and a pressure roller that constitute the fixing mechanism portion is variably controlled, based on a size of the sheet of paper to be printed, a paper pass-through direction, and a number of sheets to be printed.

8. The method for controlling a fixing mechanism portion according to claim 7, wherein variable control of the rotation speed of the heating roller and the pressure roller is based on an occurrence of a pass-through area and a non-pass-though area of a sheet of paper with respect to a roller lengthwise direction of a position at which the sheet of paper passes between the heating roller and the pressure roller, and is based on a thermal expansion coefficient of a roller diameter of the non-pass-though area.

9. The method for controlling a fixing mechanism portion according to claim 8, wherein a table showing correspondence between a surface temperature and a thermal expansion of the pressure roller is used, and the surface temperature of the pressure roller is respectively detected at the pass-through area and the non-pass-though area, and a thermal expansion coefficient of a roller diameter of the non-pass-though area is calculated by referencing the table based on the detected temperatures.

10. The method for controlling a fixing mechanism portion according to claim 9, wherein, depending on an input of a printing request and a printing condition, variable control of a rotation speed of the heating roller and the pressure roller is performed continually from a commencement until a completion of printing based on the table.

11. The method for controlling a fixing mechanism portion according to claim 10, wherein based on a transport speed of a sheet of paper that passes through the transfer mechanism portion, a variable control width of a rotation speed of the heating roller and the pressure roller is controlled in a range expressed by a relative equation of the following formula:

(transport speed of sheet that passes through transfer mechanism portion):(variable width of rotation speed of heating roller and pressure roller)=1.0:(0.95 to 1.02).

12. The method for controlling a fixing mechanism portion according to claim 7, wherein a drive member for sheet transport arranged at an upstream side in a paper transport direction of the fixing mechanism portion is controlled at an equivalent speed to a paper transport speed of the fixing mechanism portion in accordance with a variability of a paper transport speed of the fixing mechanism portion.

* * * * *